US007090327B1

(12) United States Patent
Duffield

(10) Patent No.: US 7,090,327 B1
(45) Date of Patent: Aug. 15, 2006

(54) WATER-BASED INK JET PRINTER

(75) Inventor: John P. Duffield, Meredith, NH (US)

(73) Assignee: Electronics for Imaging, Inc., Foster City, CA (US)

( * ) Notice: Subject to any disclaimer, the term of this patent is extended or adjusted under 35 U.S.C. 154(b) by 236 days.

(21) Appl. No.: 10/678,962

(22) Filed: Oct. 3, 2003

Related U.S. Application Data

(60) Provisional application No. 60/415,849, filed on Oct. 3, 2002.

(51) Int. Cl.
*B41J 2/165* (2006.01)

(52) U.S. Cl. ..... 347/30; 347/23; 347/35

(58) Field of Classification Search ..... 347/85, 347/49, 23, 30, 35
See application file for complete search history.

(56) References Cited

U.S. PATENT DOCUMENTS

| | | | |
|---|---|---|---|
| 4,328,332 | A | 5/1982 | Hayes et al. |
| 4,378,564 | A | 3/1983 | Cross et al. |
| 4,797,692 | A | 1/1989 | Ims |
| 4,890,126 | A | 12/1989 | Hotomi |
| 5,667,569 | A | 9/1997 | Fujioka |
| 5,896,154 | A | 4/1999 | Mitani et al. |
| 5,963,236 | A | 10/1999 | Miyashita et al. |
| 5,984,466 | A | 11/1999 | Nagashima et al. |
| 6,183,074 | B1 | 2/2001 | Miyashita et al. |
| 6,386,692 | B1 * | 5/2002 | Cowger et al. ..... 347/86 |
| 6,517,189 | B1 * | 2/2003 | Ogawa et al. ..... 347/35 |

FOREIGN PATENT DOCUMENTS

EP 0 736 388 B1 11/2001

* cited by examiner

*Primary Examiner*—Stephen Meier
*Assistant Examiner*—Ly T. Tran
(74) *Attorney, Agent, or Firm*—James Trosino

(57) ABSTRACT

A printer that includes at least one printhead mounted to a carriage of a printing system, and a secondary ink container mounted to the carriage and which holds an ink and is in fluid communication with the at least one printhead. A pressure source in fluid communication with the secondary ink container provides a pressure to the secondary ink container during a purging operation to cause the ink to flow from the at least one printhead. The secondary ink container has a large enough volume to hold a sufficient amount of ink for a purge operation of at least about seven seconds. The secondary ink container has a minimum ink level, and an inlet that is located below the minium ink level so as to minimize aeration of the ink as it flows through the inlet. The printer can also include a manifold having a pair of inlets, each inlet providing ink to a respective printhead, and a connector which connects the secondary ink container to the manifold, and diverts the ink to the respective manifold inlets before the ink enters the manifold. A filter can be used to filter the ink before it enters the secondary ink container, the filter having a vertical orientation to minimize the accumulation of air in the filter.

12 Claims, 5 Drawing Sheets

WATER-BASED INK JET PRINTER

RELATED APPLICATION(S)

This application claims the benefit of U.S. Provisional Application No. 60/415,849, filed Oct. 3, 2002, the entire teachings of which are incorporated herein by reference.

BACKGROUND OF THE INVENTION

Certain types of printing systems are adapted for printing images on large-scale substrates, such as for example museum displays, billboards, sails, bus boards, and banners. Some of these systems use so-called drop on demand ink jet printing. In these systems, a carriage which holds a set of print heads scans or traverses across the width of the substrate while the print heads deposit ink as the substrate moves.

Solvent based inks are sometimes used in these systems to print on flexible substrates such as PVC materials and reinforced vinyl. However, water-based inks are typically considered to be more suitable for printing on textiles. In the past, print heads used for solvent based inks could not be used with water-based inks. More recently, print heads originally used with solvent-based inks have been modified to be compatible with water-based inks.

Unfortunately, by merely replacing solvent-based print heads in existing printer systems with modified print heads which are compatible with water-based inks, other difficulties have arisen. In particular, water-based inks have a tendency to mix with air as the inks flow though the ink transport system of the printers. That is, the water-based inks tend to aerate and become "foamy," and hence degrade the printer capabilities of the printer.

SUMMARY OF THE INVENTION

The present invention implements an apparatus and method for printing with water-based inks. In one aspect of the invention, a printer includes at least one printhead mounted to a carriage of a printing system, and a secondary ink container mounted to the carriage and which holds an ink and is in fluid communication with at least one printhead. A pressure source in fluid communication with the secondary ink container provides pressure to the secondary ink container during a purging operation to cause the ink to flow from the at least one printhead. The secondary ink container has a large enough volume to hold a sufficient amount of ink for at least a seven second purge.

The printer can include a primary ink container located remotely from the carriage and in fluid communication with the pressure source and which supplies the ink to the secondary ink container. A solenoid valve in fluid communication with the secondary ink container and at least one printhead can be mounted to the carriage. The solenoid valve controls the flow of ink between the secondary ink container and the print heads. The secondary ink container can have a large enough volume for a continuous purge. The secondary ink container can be sealed, and the pressure source can supply a pressure of about 5 psi.

In another aspect of the invention, a printer includes at least one printhead mounted to a carriage of a printing system, a secondary ink container mounted to the carriage and which holds an ink, and is in fluid communication with the at least one printhead, and a filter in fluid communication with the secondary ink container and located remotely from the carriage. The filter has a vertical orientation to prevent the accumulation of air in the filter as ink is being transported from the filter to the secondary ink container.

This aspect can include a pressure source in fluid communication with the filter, with the pressure source providing a pressure to cause the ink to flow from the filter to the secondary ink container. The printer can include a primary ink container in fluid communication with the pressure source and which supplies the ink to the secondary ink container.

In another embodiment, the secondary ink container has an inlet through which the ink is provided to the secondary ink container and is positioned below a minimum level of the ink in the secondary ink container. In particular embodiments, the printer includes an ink level detector to determine the level of ink in the secondary ink container. The printer can include a controller which adjusts the ink level in the secondary ink container to ensure that the ink level is above the inlet.

In yet another embodiment, the printer includes at least one pair of printheads mounted to a carriage of a printing system, and at least one manifold coupled to and in fluid communication with each of the at least one pair of print heads. The at least one manifold has a pair of inlets, with each inlet providing an ink to a respective printhead. In some embodiments a connector has a first portion in fluid communication with one of the inlets, a second portion in fluid communication with the other inlet, and a third portion in fluid communication with the first and second portions and through which an ink is supplied to the connector. A secondary ink container mounted to the carriage and which holds the ink and is in fluid communication with the third portion of the connector.

In certain embodiments, the printer includes a filter in fluid communication with the secondary ink container and located remotely from the carriage. The filter has a vertical orientation to prevent the accumulation of air in the filter as ink is being transported from the filter to the secondary ink container. The secondary ink container can have an inlet through which the ink is provided to the secondary ink container and which is positioned below a minimum level of the ink in the secondary ink container. In particular embodiments, the printer includes a controller which adjusts the ink level in the secondary ink container to ensure that the ink level is above the inlet. In other embodiments, a pressure source in fluid communication with the secondary ink container provides a pressure to the secondary ink container during a purging operation to cause the ink to flow from the at least one printhead. In certain embodiments, the secondary ink container has a large enough volume to hold a sufficient amount of ink for at least a seven second purge. In these embodiments as well as others there can be a solenoid valve in fluid communication with the secondary ink container and the at least one pair of printheads for controlling the flow of ink between the secondary ink container and the at least one pair of printheads.

A particular advantage of some embodiments, is that they minimize or eliminate the foaming of water-based inks during the printing operation.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
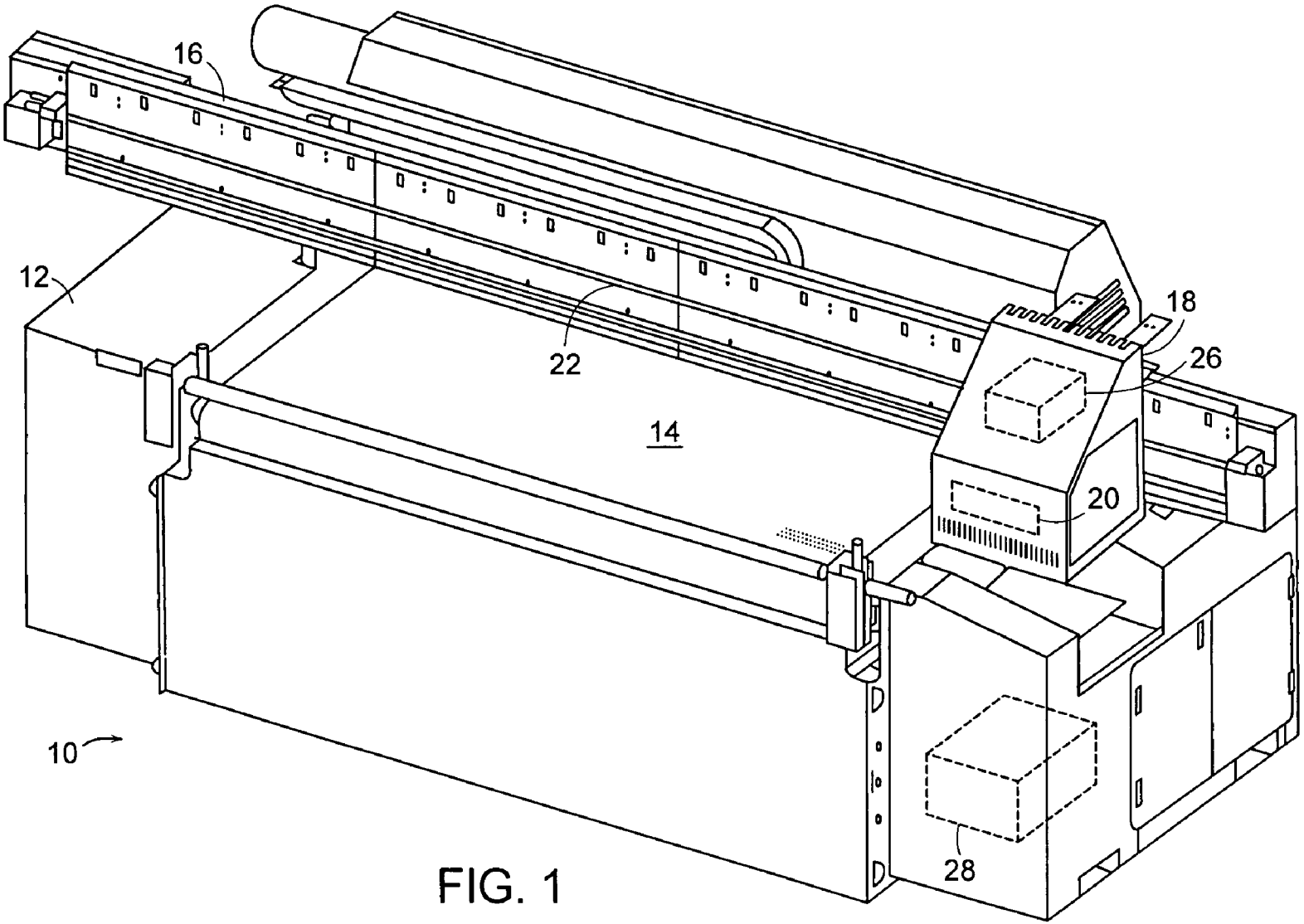
FIG. 1 is a perspective view of a printing system.

Turning now to the drawings, there is shown in FIG. 1 a printing system, generally identified as 10, provided with a carriage 18. The carriage 18 holds a series of ink jet print heads 20 (shown in phantom) configured for printing images on a variety of substrates. Typical substrates are textiles, as well as polyvinyl chloride (PVC) and reinforced vinyl. The printing system 10 is able to print on flexible as well as on non-flexible substrates, such as, for example, metals, glass, and plastics.

In addition to the carriage 18, the printing system 10 includes a base 12, a transport belt 14 which moves a substrate positioned on top of the belt 14 through the printing system 10, and a rail system 16 attached to the base 12. The carriage 18 is attached to a belt 22 which is wrapped around a pair of pulleys positioned on either end of the rail system 16. A carriage motor is coupled to one of the pulleys and rotates the pulley during the printing process. Accordingly, as the transport belt 14 intermittently moves the substrate underneath the carriage 18, and hence the series of print heads 20, the pulleys translate the rotary motion of the motor to a liner motion of the belt 22 thereby causing the carriage 18 to traverse back and forth along the rail system 16 across the substrate 23 as the series of print heads 20 deposit ink onto the substrate.

The series of print heads 20 receives one or more colored inks from a set of secondary ink containers 26 which is also mounted the carriage 18. In addition, a set of primary ink containers 28 supply the inks to the secondary ink containers 26. Unlike the secondary ink containers 26, the primary ink containers 28 are located remotely from the carriage 18, for example, within a section of the base 12 as shown in FIG. 1. Thus, the primary ink containers 28 remain stationary while the secondary ink containers 26 move with the carriage during a printing operation. In some other embodiments, the carriage 18 is stationary while the substrate moves underneath the carriage.

Figure 2:
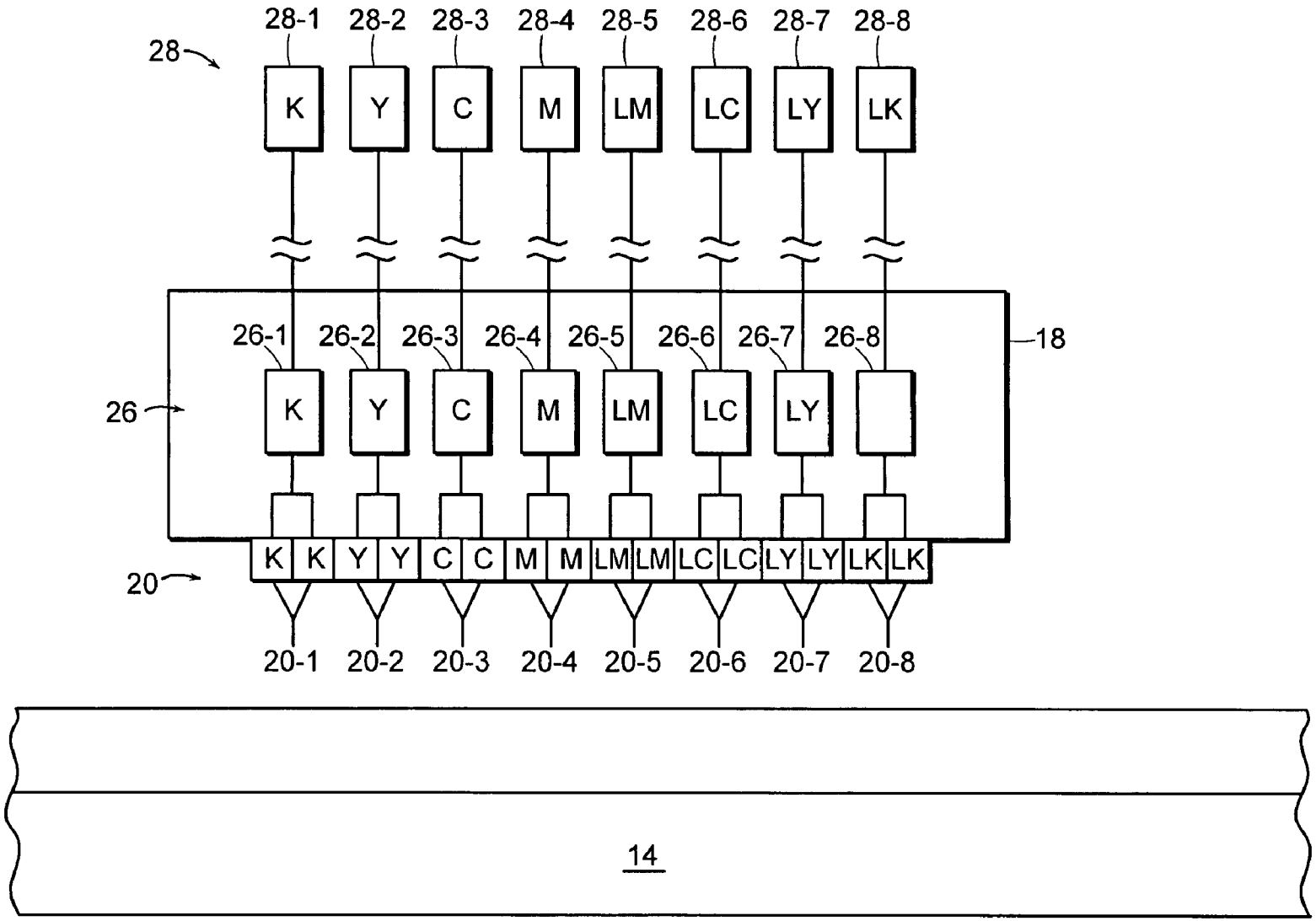
FIG. 2 is a schematic view of a carriage with printheads of the printing system of FIG. 1.

Referring now to FIG. 2, there is shown in more detail the arrangement of the series of print heads 20, the set of secondary ink containers 26, and the set of primary ink containers 28 for the illustrated embodiment. The series of print heads 20 is actually eight pairs of print heads 20-1, 20-2, 20-3, 20-4, 20-5, 20-6, 20-7, and 20-8, with each pair associated with one of the colored inks black (K), light black (LK), yellow (Y), light yellow (LY), cyan (C), light cyan (LC), magenta (M), and light magenta (LM). Accordingly, various colors of a particular image are created on a substrate 29 by combining these colored inks. A primary ink container 28-1, 28-2, 28-3, 28-4, 28-5, 28-6, 28-7, or 28-8 provides the various inks to a respective secondary ink container 26-1, 26-2, 26-3, 26-4, 26-5, 26-6, 26-7, or 26-8 which in turn supplies the inks to a respective pair of print heads 20-1, 20-2, 20-3, 20-4, 20-5, 20-6, 20-7, or 20-8. For the embodiment illustrated in FIG. 2, the print heads 20-1, 20-2, 20-3, 20-4, 20-5, 20-6, 20-7, and 20-8 are associated with the colored inks K, Y, C, M, LM, LC, LY, and LK, respectively. Note that the present invention is not limited to the arrangement shown in FIG. 2. The print heads can be associated with any colored ink. There can be fewer than or more than 16 print heads. A primary ink container and a secondary ink container can supply a respective ink to only one printhead or more than two print heads.

Figure 3:
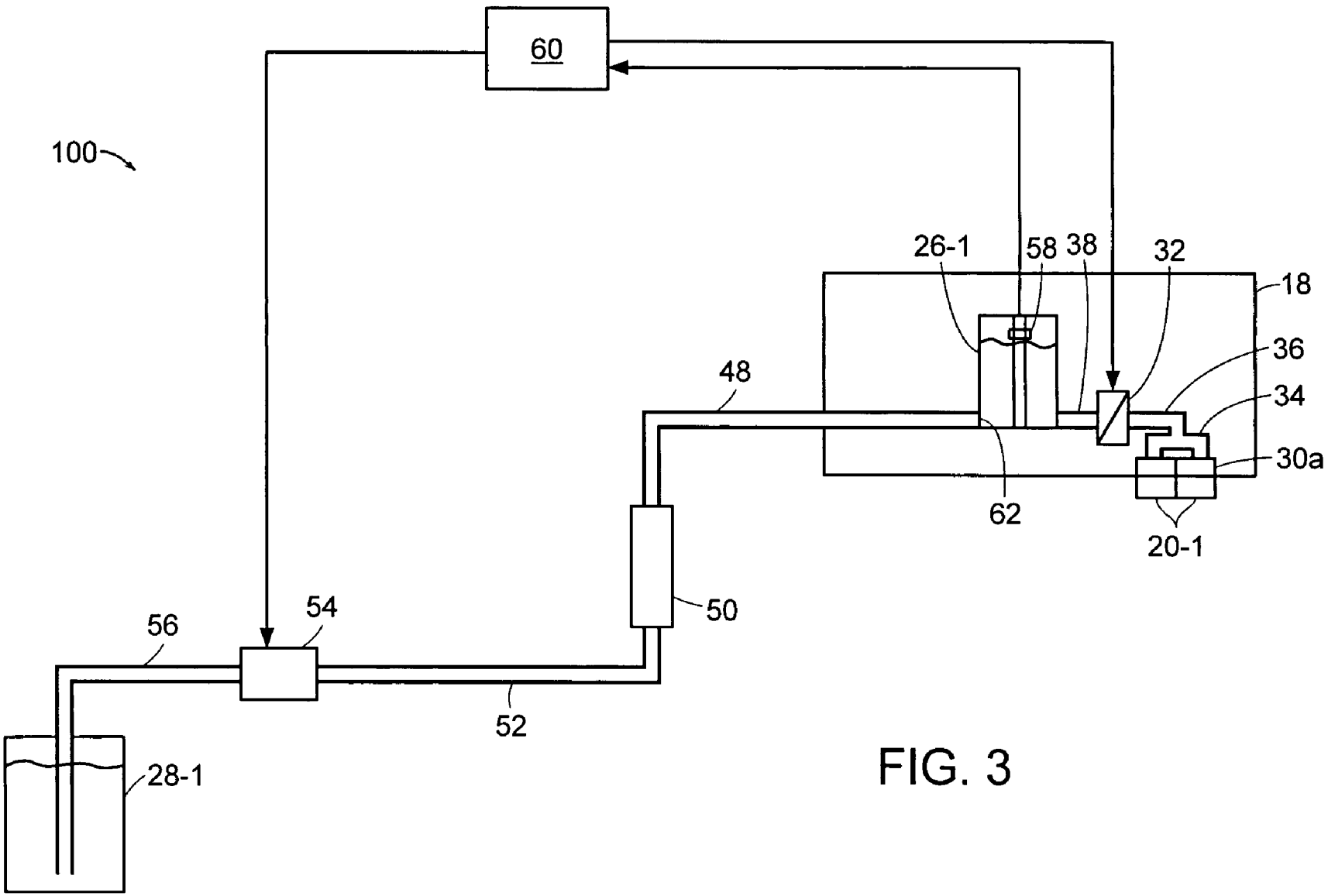
FIG. 3 is a schematic diagram of the ink transport system of the printing system of FIG. 1 in accordance with the invention.

Referring now to FIG. 3, there is shown, by way of example, an ink delivery system 100 for one pair of print heads which for the purposes of this illustration is the pair of print heads 20-1. As mentioned above, both the print heads 20-1 and the secondary container 26-1 are mounted to the carriage 18 so that they move with the carriage 18 as the carriage traverses across the substrate during a printing operation. The print heads 20-1 are coupled to a manifold 30*a* (see, e.g., FIG. 4) which is connected to a solenoid valve 32, also mounted within the carriage 18, with a connector 34 and a tube 36. The solenoid valve in turn is connected to the secondary container 26-1 with a tube 38, and the secondary ink container 26-1 is connected to the primary ink container 28-1 with a tube 48, a filter 50, a tube 52, a pump 54, and a tube 56.

The tubes can be made of LDPE or urethane and have a diameter of between about 0.125 inch to 0.375 inch. The secondary ink containers 26 have a volume of about 10 to 50 cubic centimeter. The solenoid valve is a three-way, high flow valve with a Teflon seat, and operates at 24 V, such as the valve #0091507-900 made by Parker Hannifin. The pump 54, made by, for example, Hargraves Technology, operates at about liter per minute and can produce a pressure of about 25 psig. The filter 50 is made by Pall Corp., and is about 1 inch in diameter and about 2.5 inch in length. The filter is made of polypropylene and is able capture particles as small as 8 μm.

As shown in FIG. 3, the secondary ink container 26-1 also includes an ink level sensor 58, such as a float, that provides ink level information to a controller 60. The controller 60 directs the operation of the pump 54 and the solenoid valve 32 to maintain the level of ink above an inlet 62 of the secondary ink container 26-1 through which the secondary ink container receives ink. Thus, during a printing operation, the pump 54 periodically draws ink from the primary ink container 28-1 through the tube 56 and pumps the ink through the tube 52, the filter 50, and the tube 48 to the secondary ink container 26-1. Meanwhile the solenoid valve 32 is simply open during the printing process to allow the flow of ink from the secondary ink container 26-1 to the pair of print heads 20-1 through the tube 36, the connector 34, and the manifolds 30. Note that the secondary ink containers 26 are sealed so that they can be pressurized to a pressure above ambient or a vacuum can be created in the containers.

Figure 4A:
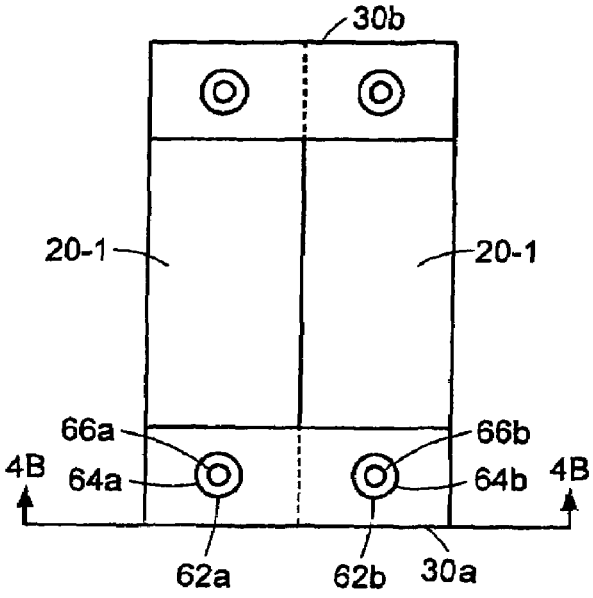
FIG. 4A is top view of a pair of manifolds coupled to a pair of printheads in accordance with the invention.
Figure 4B:
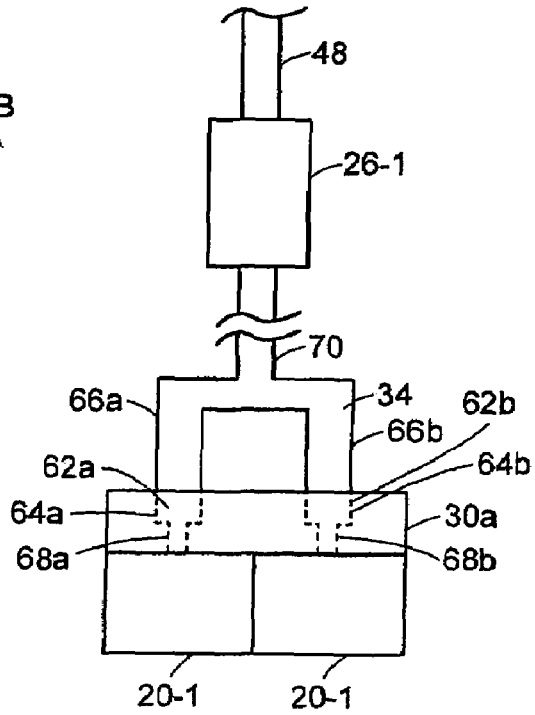
FIG. 4B is an end view along line 4B—4B of FIG. 4A of the printheads and manifolds with a connector in accordance with the invention.

A particular feature of the ink delivery system 100 that minimizes the propensity of the ink to mix with air and hence to foam is the combination of the connector 34 and the manifold 30*a*. As shown in FIGS. 4A and 4B, the manifold 30 is provided with a pair of holes 62*a* and 62*b*. The holes

62*a* and 62*b* have a larger portion 64*a* and 64*b* that connect to two extended portions 66*a* and 66*b* of the connector 34 and two smaller portions 68*a* and 68*b* that direct the ink to the respective print heads 20-1. Accordingly, as ink flows into an inlet portion 70 of the connector 34, the ink gets diverted to the pair of holes 62*a* and 62*b* through the two extended portions 66*a* and 66*b*. Thus, in essence, the ink is diverted to the two holes 62*a* and 62*b* outside the manifold 30*a*. Note that in the illustrated embodiment, in addition to the manifold 30*a* there is another manifold 30*b* (FIG. 4A) coupled to the pair of print heads 26-1. The manifold 30*b* is connected to the secondary ink container 26-1 with a connector and tube similar to the connector 34 and the tube 36 for the manifold 30*a*. Thus, the secondary ink container 26-1 supplies ink to the pair of print heads 20-1 through the manifolds 30*a* and 30*b*, with each manifold directing the ink to half of each print head of the pair of print heads.

Figure 5:
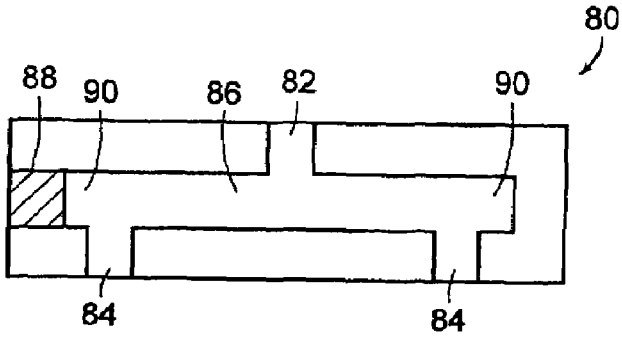
FIG. 5 PRIOR ART
FIG. 5 is a cross-sectional view of a prior art manifold.

By way of contrast, in certain prior art manifolds such as the manifold 80 shown in FIG. 5, the diversion of the ink to the pair of print heads occurs inside the manifold. To create the fluid path through the manifold 80, an inlet hole 82 and two outlet holes 84 are drilled into a block which eventually forms the manifold, then a side hole 86 is drilled into the manifold connecting the inlet hole 82 to the outlet holes 84. Finally, a plug 88 is placed in the manifold to seal off that end of the side hole 86, thereby forming the flow path from the inlet 82 to the outlets 84. However, in such manifolds, there typically are end zones 90 of the hole 86 that extend past the outlet holes 84. When ink flows through the manifold 80, air tends to get trapped in these end zones or dead spaces. Thus, over time this air mixes with the ink. Hence, the ink becomes aerated which causes the ink to foam. Furthermore, ink may accumulate in these end zones over time and dry out or polymerize.

In some circumstances, for example, when the printing system 10 has been idled for a period of time, the ink delivery system 100 is used to purge the print heads 20-1 as well as clean out the ink delivery system 100. When filled, the secondary ink container 26-1 has a large enough volume for a 5 to 8 second purge. That is, while the solenoid valve 32 is in an open state, there is a sufficient amount of ink between the maximum ink level and the minimum ink level above the inlet 62 to flush or purge the print heads 20-1 for 5 to 8 seconds without the ink level falling below the inlet. Furthermore, the pump 54 is able to pump enough ink from the primary ink container 28-1 to the secondary ink container 26-1 so that the ink delivery system 100 is able to continuously purge the print heads 20-1 for a much longer period of time so long as there is ink in the primary container 28-1.

A particular feature of the ink delivery system 100 is that the controller 60 in combination with the sensor 58 is able direct the operation of the solenoid valve 32 and/or the pump 54 to keep the minimum ink level above the inlet 62 of the secondary ink container 26-1 during a purging operation. By keeping the minimum ink level above the inlet 62, air cannot mix with the ink as it flows through the inlet 62 into the secondary ink container 26-1. This prevents the ink from aerating so that the ink does not become foamy.

Figure 6A:
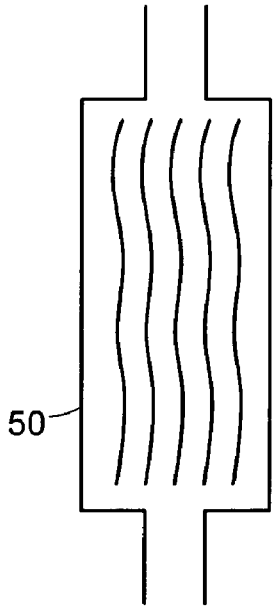
FIG. 6A is a cross-sectional view of a filter of the ink transport system of FIG. 3 in accordance with the invention.
Figure 6B:
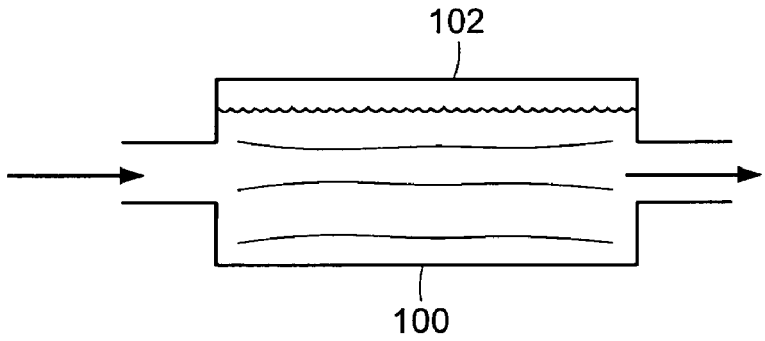
FIG. 6B PRIOR ART
FIG. 6B is a cross-sectional view of a prior art filter.

There are other features of the ink delivery system 100 that minimize the tendency for the water-based ink from mixing with air and getting foamy. For instance, as can be seen in FIG. 3, as well as FIG. 6A, the filter 50 has a vertical orientation. This orientation prevents the accumulation of air within the filter which can mix with the ink. In contrast, as shown in FIG. 6B, a filter 100 with a horizontal orientation tends to have a pocket of air 102 in the upper part of the filter 100. As the ink flows through the filter 100, the air in this pocket 102 tends to mix with the ink over time, hence, making the ink foamy.

While this invention has been particularly shown and described with references to preferred embodiments thereof, it will be understood by those skilled in the art that various changes in form and details may be made therein without departing from the scope of the invention encompassed by the appended claims.

What is claimed is:

1. A printer comprising:

a printhead mounted to a carriage of a printing system;

an ink container mounted to the carriage and in fluid communication with the printhead, the ink container comprising an inlet through which the ink container receives ink; and a pressure source in fluid communication with the ink container, the pressure source providing a pressure to the ink container during a purging operation to cause the ink to flow from the printhead, wherein the ink container is adapted to hold a sufficient amount of ink to purge the printhead for about seven seconds without an ink level in the ink container dropping below the inlet.

2. The printer of claim 1, further comprising a primary ink container located remotely from the carriage and in fluid communication with the pressure source and which supplies the ink to the ink container.

3. The printer of claim 2, further comprising a solenoid value in fluid communication with the ink container and the printhead, the solenoid valve controlling the flow of ink between the ink container and the printhead.

4. The printer of claim 1, wherein the ink container has a large enough volume for a continuous purge.

5. The printer of claim 1, wherein the pressure source supplies a pressure of about 5 psi.

6. The printer of claim 1, wherein the ink container has a volume that is about 10 cubic centimeters or greater.

7. The printer of claim 6, wherein the ink container has a volume that is between about 10 and about 50 cubic centimeters.

8. The printer of claim 1, wherein the ink container has a maximum ink level and a minimum ink level, the inlet is located below the minimum ink level, and wherein the ink container contains a sufficient amount of ink between the maximum ink level and the minimum ink level to purge the printhead for approximately 5 to 8 seconds without the ink falling below the minimum ink level.

9. A method of purging a print head in a printing system comprising an ink container in fluid communication with the print head, the ink container comprising an inlet through which the ink container receives ink, the method comprising:

supplying ink from the ink container to the print head; and pressurizing the ink container with a pressure source to purge the print head continuously for about seven seconds without causing an ink level in the ink container to drop below the inlet.

10. The method of claim 9, further comprising controlling the flow rate of the ink between the ink container and the print head with a solenoid valve.

11. The method of claim 9, wherein pressuring comprises pressuring the ink container with a pressure of about 5 psi.

12. The method of claim 9, further comprising controlling the pressure source and the solenoid valve with a controller.

* * * * *